United States Patent [19]

Hanner

[11] 4,004,800

[45] Jan. 25, 1977

[54] LONG JUMP MARKING BOARD

[76] Inventor: Richard E. Hanner, 8455 Laurel Lane, Loomis, Calif. 95650

[22] Filed: June 26, 1975

[21] Appl. No.: 590,657

[52] U.S. Cl. ..... 272/101; 160/130; 273/183 A

[51] Int. Cl.[2] ..... A63K 3/04

[58] Field of Search ..... 272/59 R, 59 A, 59 B, 272/59 C, DIG. 5; 273/183 A; 160/130, 174, 166 R; 49/371

[56] References Cited

UNITED STATES PATENTS

| | | | |
|---|---|---|---|
| 2,349,544 | 5/1944 | Fiedler | 49/371 |
| 2,887,153 | 5/1959 | Longley | 49/74 X |
| 3,343,843 | 9/1967 | Stanko | 273/195 A X |
| 3,429,067 | 2/1969 | Yancey | 272/8 R |
| 3,815,923 | 6/1974 | Goduto | 273/195 A |

*Primary Examiner*—Jerome Schnall
*Attorney, Agent, or Firm*—Townsend and Townsend

[57] ABSTRACT

A long jump marking board that discloses the point of take-off of a long jump in athletic competition or practice comprising an array of elongate marking elements pivotally mounted to a base. The elements are closely spaced, parallel to each other, and transverse to the direction of the jump. Prior to use, the elements are situated in a first position extending substantially upward from the base. When a jump is made, using the marking board as a take-off point, an athlete's foot will contact a number of the elements and cause them to be pivoted to a second position angularly disposed to the base. The pivoted elements remain in the second position illustrating the point of foot contact and the take-off point of the jump. An accurate measurement may then be taken from the take-off point to the landing point. A reset mechanism is provided to reset all pivoted members to their original upright position.

6 Claims, 5 Drawing Figures

FIG _ 1
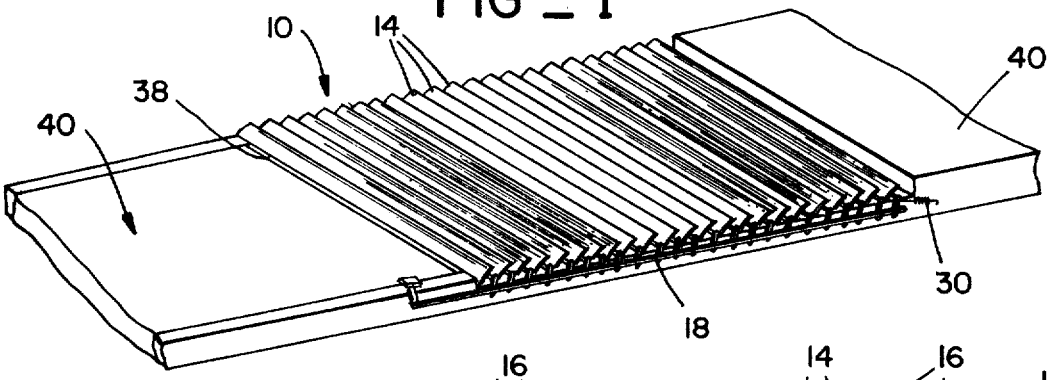
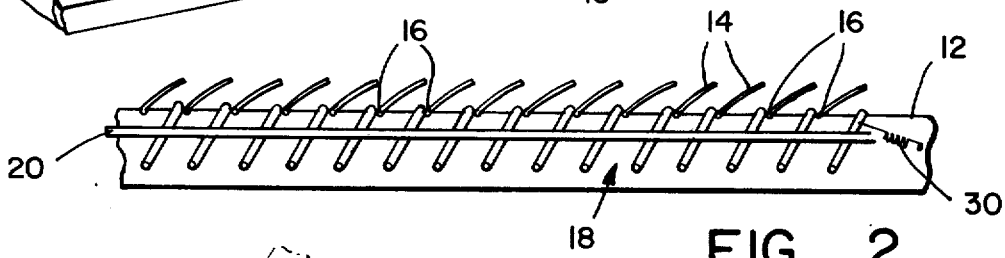
FIG _ 2
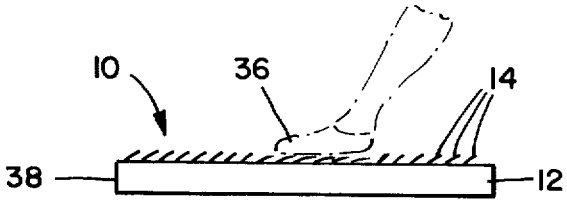
FIG _ 3a
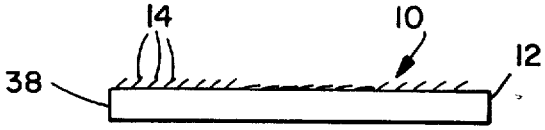
FIG _ 3b
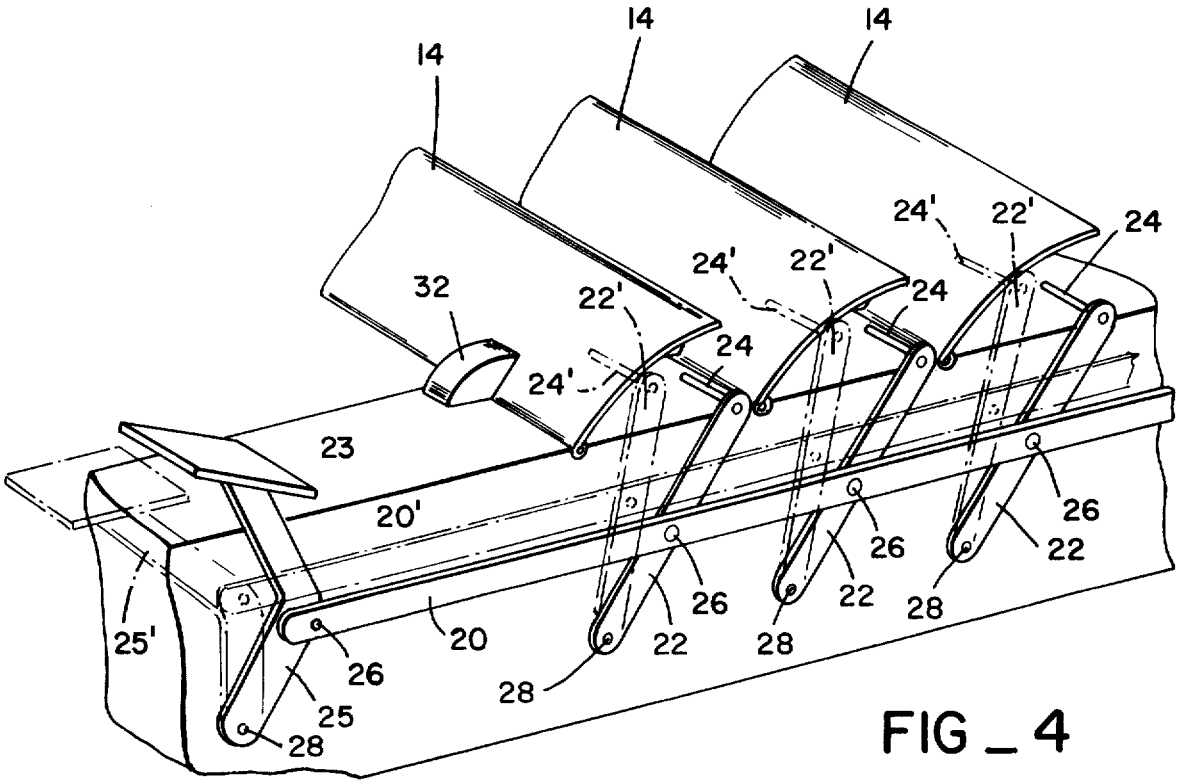
FIG _ 4

LONG JUMP MARKING BOARD

BACKGROUND OF THE INVENTION

1. Field of the Invention

This invention relates generally to track-and-field apparatus and more particularly to a device for use in those track-and-field athletic events requiring an accurate marking of the point of take-off such as long and triple jump events.

2. Description of the Prior Art

Track-and field athletics usually include such activities commonly referred to as the long (broad) and triple jump where the object of the event is a jump for distance from a running start. The long jump track normally provided for these events includes a dirt runway and a sand-filled landing area separated by a fixed take-off board, approximately six inches wide.

Typically, the athlete begins a long jump by a momentum-gathering run down the dirt runway towards the take-off board and landing area. The jump itself is made from the take-off board from a point on the board as close as possible to the board edge, adjacent the landing area. The jump terminates at the point in the landing area the athlete first contacts after leaving the take-off board. In the triple jump event the take-off board continues to initiate the first jump (hop), but two more jumps immediately follow, and are contiguous to, the first jump.

According to the rules under which such jumping events are conducted, the distance of a jump is measured from the edge of the take-off board to the point of impact in the landing area. The edge of the take-off board is used for measurement irregardless of where the runner's foot leaves the ground. However, the rules are quite specific on the point that if a runner's foot, when making the jump, steps over the board into the landing area, his jump effort is negated.

Thus, an athlete intent upon making the best jump possible, must concentrate on a take-off point on the take-off board that is close to, but does not overlap, the edge of the take-off board adjacent the landing area. It may be readily recognized by those who have participated in such events that this is not an easy task. For, as with many other competitive activities, the keener the competition, the more important inches and fractions of inches become. An athlete, intent upon not having his jump negated, can lose significant distances by initiating his jump back from the edge of the take-off board from which measurement is taken. Thus the difference between a winning jump and an excellent but losing jump is often determined at the take-off board; and at times can be nothing more than a matter of luck. Moreover, an athlete's performance may be impaired by undue concentration towards achieving the proper take-off point from the take-off board.

Furthermore, training for such track-and-field events as the triple jump, which consists of a series of three connected jumps from one running start, poses problems for the athlete. The first two jumps, of the triple jump series, are made on a hard surface. The athlete has no indication of the distances of his first two jumps unless he is witnessed by one or two observers. A knowledge of the individual jump distances that make up the triple jump is essential to enable the athlete to concentrate on those portions of his jump that will extend his overall jumping distance.

Thus, the prior art take-off board used in such track-and-field events as the long jump and the triple jump, detracts from an athlete's best performance, hinders his training, and tends to award victory to those who are, in part, lucky enough to achieve a non-disqualifying take-off point from the take-off board inches or fractions of inches ahead of their competitors.

SUMMARY OF THE INVENTION

The present invention remedies and overcomes all of the foregoing deficiencies and disadvantages associated with take-off boards presently being used in track-and-field events such as the long and triple jump. This invention provides a long jump marking board that replaces the take-off board presently being used. The present invention provides an accurate indication of the jumper's point of take-off by utilizing a plurality of elongate elements pivotally mounted to the top of a rectangular base member. The elongate elements are closely spaced and transverse to the direction of the jump, i.e., transverse to the runway. Contact is made between an athlete's foot and the elements when the board is used as a take-off point for a jump. This contact causes those elements contacted to pivot (be depressed) from a first substantially upright position to a second substantially horizontal position. The pivoted (depressed) elements disclose the point of take-off from which accurate measurement can then be made to the landing point in the sand. In a preferred form, the pivoted members are provided with a reset mechanism to restore them to their original upright position prior to the next jump.

BRIEF DESCRIPTION OF THE DRAWINGS

FIG. 1 is a perspective view of the long jump take-off board of this invention;

FIG. 2 is a fragmentary side elevation view thereof;

FIG. 3*a* and 3*b* are schematic representations of the use of this invention; and FIG. 4 is a fragmentary side elevation of the long jump marking board of this invention illustrating the use of the reset mechanism to dispose the pivoted elements to their original upright position.

DESCRIPTION OF THE PREFERRED EMBODIMENT

Referring now to the drawings and particularly to FIG. 1, the long jump marking board is indicated generally at 10. The marking board comprises a rectangular base 12, a plurality of elongate marking elements 14, and a reset mechanism 18. Board 10 typically extends approximately 36–40 inches in the jump direction. A typical width transverse to the jump direction measures approximately 36 inches.

Referring now to FIGS. 1 and 2, it can be seen that the elongate marking elements 14 are pivotally mounted to base 12 by pins (bolts) 16 and extend upward therefrom so that they are in a substantially upright position. Marking elements 14 have a slight arcuate cross-section with the direction of the bend away from landing area 40. The height of members 14 are approximately ½ inch, preferably spaced approximately ½ inch apart.

Elongate members 14 are held in their upright position by frictional engagement with pins 16 and will remain in the upright position until pivoted to a position substantially horizontal by an athlete's foot when taking off for a jump.

Referring now to FIG. 3*a*, there is illustrated a jumper's foot 36 using the marking board 10 as a take-off board for a jump. FIG. 3*b* shows the long jump marking board, after a jump has been made, illustrating the take-off point as represented by those elements 14 pivoted to a substantially horizontal position. The length of the jump is determined by measuring from the pivoted element nearest edge 38 of base 12 to the jumper's landing point in landing area 40.

Referring now to FIG. 4, there is illustrated the use of reset mechanism 18 to reset pivoted elements 14 from their displaced, substantially horizontal position to their original upright positions. Reset mechanism 18 comprises actuator 25, pull bar 20, and reset levers 22. As illustrated, one reset lever 22 is provided for each element 14. Each reset lever 22 (as well as the foot actuator 25) is pivotally mounted at one end to base 12 by pins 28. Foot plate 22 is secured to the actuator 25 opposite from pin 28. The other end of each reset lever 22 has attached thereto a transverse finger 24, adapted to engage respective horizontally displaced elements 14 during the reset operation. Each reset lever 22, as well as foot actuator 25, is pivotally attached to pull bar 20 by pins 26. A helical spring 30 (FIG. 2), the ends of which are attached to the outermost reset lever 22 and base 12, is provided to return the reset mechanism to its rest position.

As further illustrated in FIG. 4, each element 14 can be provided with a stop 32 to prevent the elements from being returned to a position beyond generally upright.

As illustrated in FIG. 3*b*, in the resetting operation, there are a number of elements 14 disposed in a horizontal position marking the take-off point of a jump. To reset these horizontally disposed elements, the operator places his foot on foot plate 23 of actuating lever 25 to cause the actuating lever to pivot about its connection pin 28 to a position 25'; as indicated in phantom on FIG. 4. This rotation of actuating lever 25 produces a similar rotation in reset levers 22 through advancement of pull bar 20. Thus, as indicated in FIG. 4 in phantom, reset levers 22 are pivoted to reset positions 22'. As reset levers 22 are so pivoted, fingers 24 will engage the horizontally disposed elements 14, moving them to their original upright positions.

Reset mechanism 18 is returned to its pre-reset position, indicated in FIG. 4 by solid lines, by spring 30 when the user's foot is removed from foot plate 23 of actuator lever 25.

Preferably, elements 14 are fabricated from a durable and relatively hard rubber. Alternatively, elements 14 can be manufactured from a metallic material. However, elements 14 fabricated from metal would preferably require a surface coating of rubber or the like to increase friction, thereby increasing their traction capabilities.

Substitution of the long jump marking board for the take-off board currently in use may be made in two ways. The board may be placed between the sand-filled pit and the runway so that the arcuate bend of members 14 will tend to point away from the landing area and towards the athlete as he approaches board 10 to make his jump. Alternatively, to increase traction, board 10 may be placed with the arcuate bend tending to point towards the sand-filled landing area and towards the direction of the jump.

Portions of the long jump marking board can be high-lighted by contrasting colors to provide areas for an athlete to "aim" for when approaching the board in his momentum-gathering run preliminary to the jump. Thus, as depicted by shading in FIG. 1, a number of centrally located elements 14 are of a contrasting color with respect to the remaining elements.

It should be apparent to those versed in track-and-field athletics that the use of this invention need not be limited to a take-off marker for long jump or triple jump events. For example, and as mentioned above, when training for the triple jump event it is often desirable to know the jump distances of the individual jumps which make up the overall distance of the triple jump. Thus, the marker board concept could be used to fabricate a marker board of sufficient length to record the landing and take-off points of each jump during triple jump practice. An athlete can thereby determine which portions of the triple jump he feels need improvement.

Thus, it is a primary object of this present invention to provide a long jump marking board that minimizes disqualification of a jump when the athlete's foot inadvertently extends beyond the edge of the take-off board. Moreover, this invention enables an accurate measurement of not only the athlete's jump, but of his true ability. This will insure that the horizontal jumping events of track-and-field athletics are contests of athletic prowess rather than luck.

It is to be understood that the form of this invention herewith shown and described is to be taken as a preferred example of the same, and that this invention is not to be limited to the exact arrangement of parts shown in the accompanying drawings or described in this specification as various changes in the details of construction as to shape, size, materials and arrangement of parts may be resorted to without departing from the spirit of the invention, the scope of the novel concept thereof, or the scope of the sub-joined claims.

I claim:

1. A running long jump take-off board for indicating the initiation of a running jump comprising:

a generally elongated base member having a planar, continuous horizontally disposed upper surface;

a plurality of generally elongate longitudinally parallel, spaced flat strip elements disposed in parallel, overlying relation to and supported by said upper surface extending transverse a direction of said board and of said running jump, each of said elements having a lower elongated edge pivotally mounted to said base member and being adapted to be individually pivoted to occupy a first upright angularly disposed position and a second substantially horizontal position, each of said elements being pivoted on said lower edge to move from said first position to said second position independently of each other, each of said elements including an upper edge disposed with respect to said lower edge, towards a point of commencement of said running jump when said elements are in said first and second positions, said second position disclosing the contact point of an athlete's foot when said elements, occupying said first position, are contacted by an athlete's foot as the jump is initiated; and means connected to said base for returning said elements from said second position to said first position including stop means for preventing said elements to occupy a position beyond said first position.

2. The article of manufacture for indicating the initiation of a running jump as recited in claim 1, wherein said elements are arcuate in cross-section.

3. The article of manufacture for indicating the initiation of a running jump as recited in claim 1, wherein said returning means comprises:

a plurality of arm members pivotally attached to said base and having at one end thereof fingers, said fingers positioned on said arm members for engaging said elements;

a pull bar pivotally attached to each said arm member and having a first and second position such that movement of said pull bar from said first position to said second position will cause said arm members to pivot about respective attachment points with said base causing said fingers on said arm members to engage said elements to dispose said elements to said first substantially upright position.

4. The article of manufacture for indicating the initiation of a running jump as recited in claim 3, wherein said disposing means includes:

foot actuating means for activating said pull bar to dispose said finger members from said first position to said second position.

5. The article of manufacture for indicating the initiation of a running jump as recited in claim 2, wherein said elements are hard rubber.

6. The article of manufacture for indicating the initiation of a running jump as recited in claim 1, wherein various of said elements are provided with indicia to produce a target for an athlete.

* * * * *